US010759451B2

(12) United States Patent
Sakurai

(10) Patent No.: US 10,759,451 B2
(45) Date of Patent: Sep. 1, 2020

(54) GAP FILLER

(71) Applicant: KYOSAN ELECTRIC MFG. CO., LTD., Yokohama-shi, Kanagawa (JP)

(72) Inventor: Ikuo Sakurai, Tachikawa (JP)

(73) Assignee: KYOSAN ELECTRIC MFG. CO., LTD., Yokohama-shi, Kanagawa (JP)

( * ) Notice: Subject to any disclaimer, the term of this patent is extended or adjusted under 35 U.S.C. 154(b) by 223 days.

(21) Appl. No.: 16/137,818

(22) Filed: Sep. 21, 2018

(65) Prior Publication Data

US 2019/0092348 A1 Mar. 28, 2019

Related U.S. Application Data

(63) Continuation of application No. PCT/JP2016/059337, filed on Mar. 24, 2016.

(51) Int. Cl.
*B61B 1/02* (2006.01)

(52) U.S. Cl.
CPC ..... *B61B 1/02* (2013.01)

(58) Field of Classification Search
CPC .. B61B 1/02; B60R 3/02; B60R 3/002; B60R 2013/046; A61G 3/061; A61G 3/067; A61G 3/062; Y10S 414/134; B61D 23/02; B61D 47/00; B60P 1/433
USPC ..... 105/436
See application file for complete search history.

(56) References Cited

U.S. PATENT DOCUMENTS 2,118,557 A * 5/1938 Hamilton ..... B60R 3/02 280/166
3,833,240 A * 9/1974 Weiler ..... B60R 3/02 280/166
3,887,217 A * 6/1975 Thomas ..... B60R 3/02 280/166
4,110,673 A * 8/1978 Magy ..... B60R 3/02 105/444
4,116,457 A * 9/1978 Nerem ..... B60R 3/02 280/166
6,325,397 B1 * 12/2001 Pascoe ..... B60R 3/02 280/163

(Continued)

FOREIGN PATENT DOCUMENTS

EP 0 738 642 * 10/1996
JP 2005-14805 A 1/2005

(Continued)

*Primary Examiner* — Mark T Le
(74) *Attorney, Agent, or Firm* — Muncy, Geissler, Olds & Lowe, P.C.

(57) ABSTRACT

A swing body engages with a driving end roller of a linearly moved driving slider at a driving end section. The swing body engages with a guide groove in a driven slider at a driven end section. The driven slider is coupled to a gap filler plate by a driven end roller changeable in installation position in a predetermined direction. A gap filler has an inverse motion preventive structure that, when the gap filler plate is in either a fully protruded state or a fully stored state, enables only forward motion transfer from the driving slider to the swing body. The guide groove is formed in a direction orthogonal or almost orthogonal to forward and backward movement directions of the gap filler plate. The predetermined direction and the direction of the guide groove are parallel to each other in the fully stored state.

7 Claims, 10 Drawing Sheets

(56) References Cited

U.S. PATENT DOCUMENTS 8,297,635 B2 * 10/2012 Agoncillo ..... B60R 3/02
280/163

FOREIGN PATENT DOCUMENTS

| | | | |
|---|---|---|---|
| JP | 2007-022335 | A | 2/2007 |
| JP | 2015-143052 | A | 8/2015 |
| KR | 20080016491 | A | 2/2008 |

* cited by examiner

[SEC. B-B]

GAP FILLER

CROSS REFERENCE TO RELATED APPLICATION

This application is a continuation of International Patent Application No. PCT/JP2016/059337, having an international filing date of Mar. 24, 2016, which designated the United States, the entirety of which is incorporated herein by reference.

BACKGROUND

The present invention relates to a gap filler that is installed at a platform in a railroad station to fill the gap between a train and the platform.

In recent years, gap fillers have been installed at platforms in an increasing number of stations. The platform gap filler is a device that protrudes a gap filler plate from the platform to reduce the gap between a train and the platform at the time of passengers' getting on and off. The platform gap filler stores the gap filler plate on the platform side at times other than during passengers' getting on and off, and protrudes the same to the railway track side at the time of passengers' getting on and off to narrow the gap between the platform and the train and prevent passengers' falling (for example, refer to JP-A-2005-14805).

A conventional platform gap filler includes a brake mechanism and a lock mechanism that prevent displacement of a gap filler plate by reaction force of passengers' treading on the gap filler plate when the gap filler plate protrudes from the platform at the time of passengers' getting on and off. The lock mechanism is operated by electromagnetic force as described in JP-A-2005-14805 and thus changing the locked state requires electric power. This configuration also increases the parts count related to electric control to boost the manufacturing cost. In addition, the electric and electronic parts are not easier to determine the degree of deterioration at a glance than mechanical parts, which leads to increase in man-hour of maintenance checkup.

A platform with a gap filler may be located in not only a linear section but also a curve section of a railway track. To install the gap filler in the curve section of the platform, it is necessary to decide the amount of protrusion of the gap filler plate at each of installation positions because the gap between a train and the platform varies depending on the position of the door. Accordingly, it is necessary to design and manufacture the gap filler suited to the installation position. In this case, larger numbers of unique components and devices are used to cause a price increase. In addition, there may occur erroneous orders and wrong assembly at installation sites.

The protruding action of the gap filler plate from the fully stored state to the fully protruded state desirably takes place such that the gap filler plate starts to move slowly, increases speed gradually, reaches the maximum speed midway, decreases speed gradually, and then approaches slowly to the fully protruded state.

SUMMARY

According to one aspect of the invention, there is provided a gap filler that protrudes a gap filler plate to a track side to prevent passengers' falling from a platform, comprising:

a drive mechanism section that moves linearly a linear motion body;

a swing body that has a driving end section and a driven end roller section, the driving end section being engaged with the linear motion body and the driven end roller section being engaged with the gap filler plate and changeable in installation position in a predetermined direction; and a driven slider that has a guide groove in which the driven end roller section is capable of rolling to convert swing motion of the swing body into linear motion and move the gap filler plate in forward and backward movement directions, wherein an engagement relationship between the linear motion body and the driving end section constitutes an inverse operation preventive structure that, when the gap filler plate is in either a fully protruded state or a fully stored state, enables only motion transfer from the linear motion body to the driving end section, the guide groove is formed in a direction orthogonal or almost orthogonal to forward and backward movement directions of the gap filler plate, and the predetermined direction and the direction of the guide groove are parallel to each other in the fully stored state.

DESCRIPTION OF EXEMPLARY EMBODIMENTS

Figure 1:
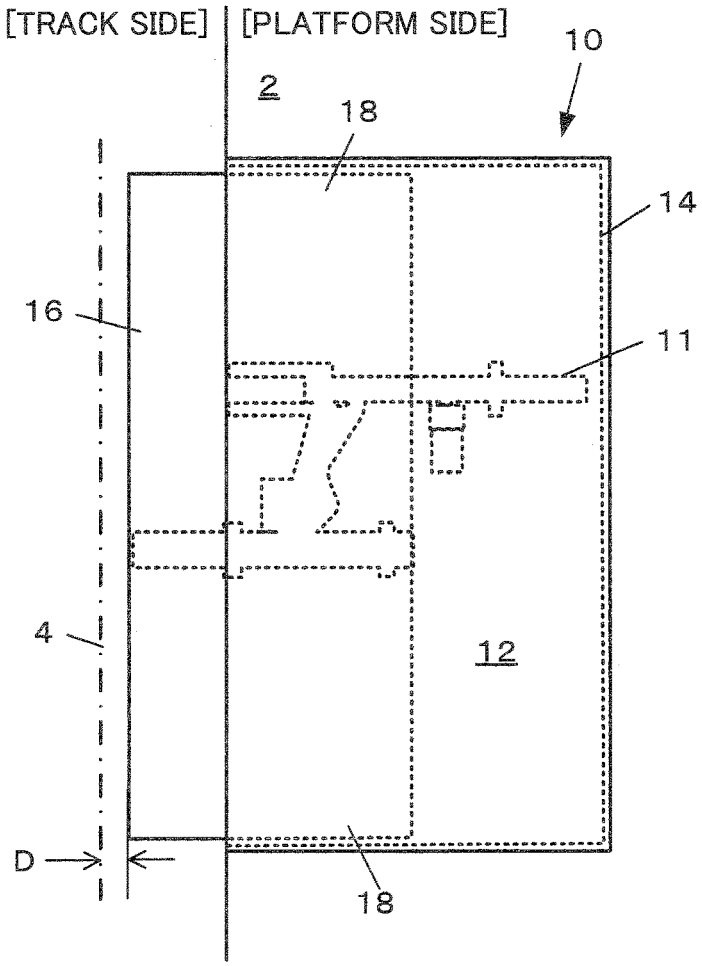
FIG. 1(1) is a top view of a platform gap filler in an installed state, and FIG. 1(2) is a side view of the same.
Figure 1:
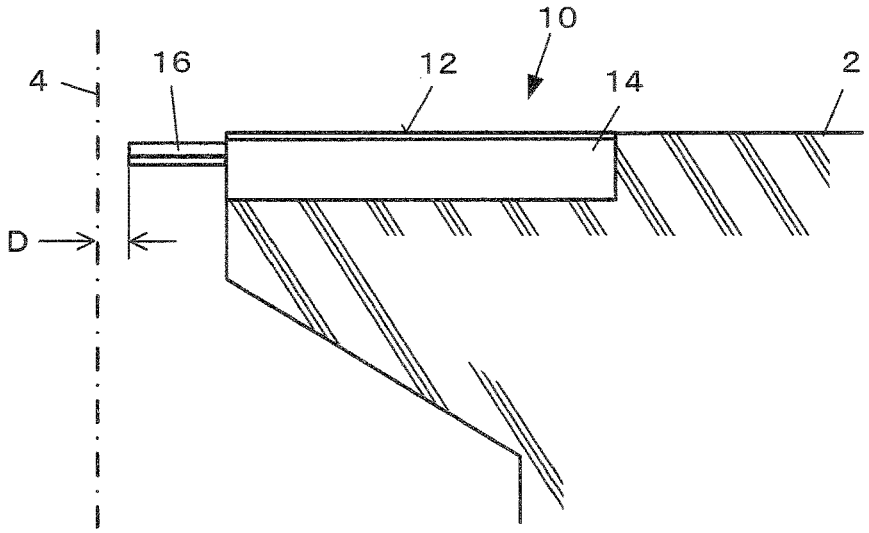

According to the embodiment, it is possible to implement a lock mechanism for gap filler that is simple in mechanical structure and is capable of adjusting the protrusion amount of a gap filler plate. In addition, it is possible to provide a gap filler that allows the protrusion action of a gap filler plate from the fully stored state to the fully protruded state such that the gap filler plate starts to move slowly, increases speed gradually, reaches the maximum speed midway, decreases speed gradually, and then approaches slowly to the fully protruded state.

According to one embodiment of the invention, there is provided a gap filler that protrudes a gap filler plate to a track side to prevent passengers' falling from a platform, comprising:

a drive mechanism section that moves linearly a linear motion body;

a swing body that has a driving end section and a driven end roller section, the driving end section being engaged with the linear motion body and the driven end roller section being engaged with the gap filler plate and changeable in installation position in a predetermined direction; and a driven slider that has a guide groove in which the driven end roller section is capable of rolling to convert swing motion of the swing body into linear motion and move the gap filler plate in forward and backward movement directions, wherein an engagement relationship between the linear motion body and the driving end section constitutes an inverse operation preventive structure that, when the gap filler plate is in either a fully protruded state or a fully stored state, enables only motion transfer from the linear motion body to the driving end section, the guide groove is formed in a direction orthogonal or almost orthogonal to forward and backward movement directions of the gap filler plate, and the predetermined direction and the direction of the guide groove are parallel to each other in the fully stored state.

In the gap filler, the predetermined direction may be set to avoid a center of a swing shaft of the swing body.

In the gap filler, the inverse operation preventive structure may establish an engagement relationship satisfying a geometric condition that, in either the fully protruded state or the fully stored state, a direction of action from the driving end section to the linear motion body is orthogonal or almost orthogonal to a linear motion direction of the linear motion body.

In the gap filler, the linear motion body may include a roller for engagement with the driving end section, and the driving end section may have rolling surfaces for the roller including two lock surfaces and a changeover surface, one surface of the two lock surfaces may contact the roller in the fully protruded state and may have a direction of a normal orthogonal or almost orthogonal to the linear motion direction, the other surface of the two lock surfaces may contact the roller in the fully stored state and may have a direction of a normal orthogonal or almost orthogonal to the linear motion direction, and the changeover surface may be an arc-shaped surface contacting the roller during changeover between the fully protruded state and the fully stored state and connecting the two lock surfaces.

In the gap filler, the drive mechanism section may have a rack-and-pinion mechanism.

A platform gap filler as one embodiment to which the present invention is applied will be described in outline below.

FIG. 1(1) is a top view of a platform gap filler 10 in an installed state and FIG. 1(2) is a side view of the same. The platform gap filler 10 is fixed in an installation space that is recessed on the top of a side edge of a platform 2 in a station.

Figure 2:
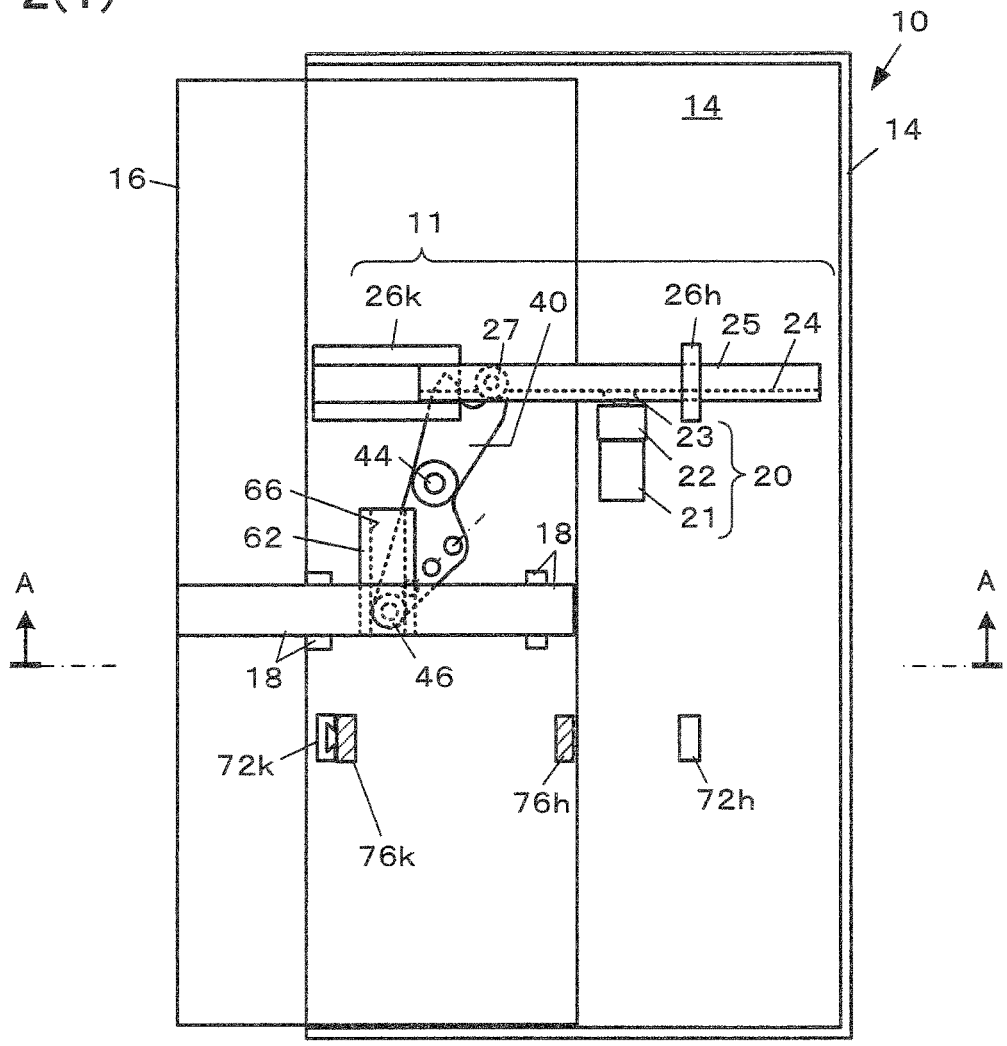
FIG. 2(1) is a top view of an example of internal structure of the platform gap filler in a fully protruded state, and FIG. 2(2) is an enlarged partial view of the same.
Figure 2:
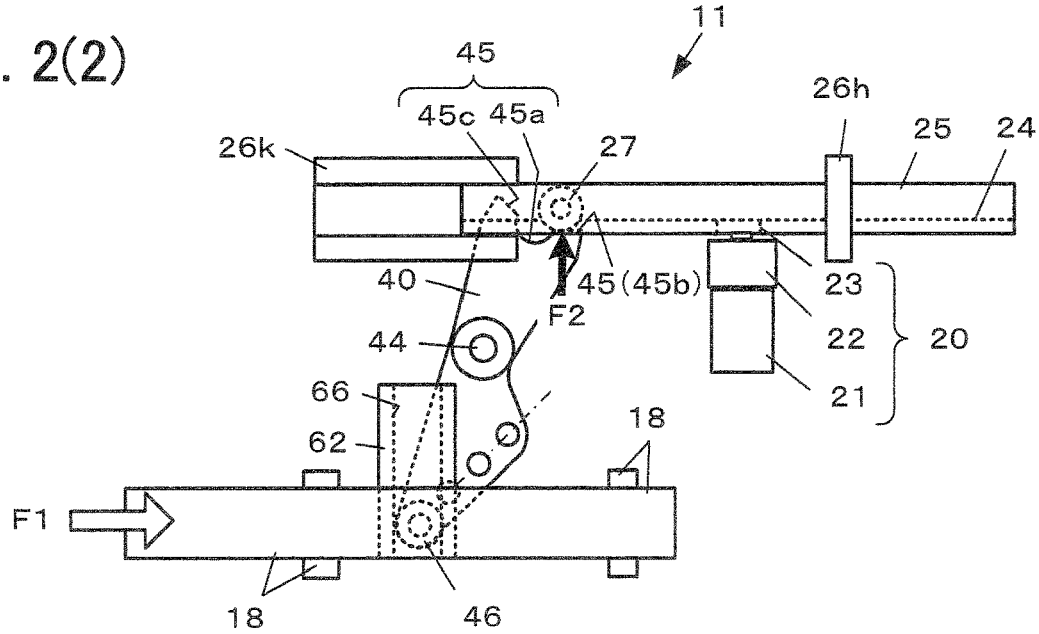

The platform gap filler 10 defines a thin cuboid internal space opened to the track side by a main frame 14 fixed in the installation space and a top plate 12 acting as a cover of the main frame 14, and has a gap filler plate 16 supported in an almost horizontally slidable manner in the internal space by a ball-bearing slide rail 18 (see FIG. 2). The platform gap filler 10 can move the gap filler plate 16 forward and backward to the track side and the platform side by a forward/backward movement mechanism section 11.

At times other than during passengers' getting on and out a train 4, the gap filler plate 16 is stored in the internal space and kept in a movement suppressed state so that the track-side end of the gap filler plate 16 does not protrude to the railway track side beyond a regulated position. This state will be called "fully stored state".

At times of passengers' getting on and out the train 4, as the forward/backward movement mechanism section 11 is activated, the gap filler plate 16 is automatically shifted to a movable state. The gap filler plate 16 is protruded to the track side to reduce a gap D between the platform and the train 4 and prevent passengers from falling between the platform and the train. This state will be called "fully protruded state". FIGS. 1(1) and 1(2) both illustrate the "fully protruded state". In the fully protruded state, the gap filler plate 16 is automatically switched from the movable state to the movement suppressed state. The gap filler plate 16 is kept in the current position against an input from the gap filler plate 16 side (for example, reaction force or the like generated during passengers' treading on the gap filler plate 16 and getting on the train). That is, the gap filler plate 16 is brought into a locked state.

Then, after passengers' getting on and off, the forward/backward movement mechanism section 11 operates inversely. Even though the gap filler plate 16 is in the movement suppressed state, when the forward transfer of driving force is started by the activation of the forward/backward movement mechanism section 11, the gap filler plate 16 is automatically switched to the movable state. Then, the gap filler plate 16 is moved to the platform side and returned to the "fully stored state" by the transferred power. The gap filler plate 16 is automatically brought into the movement suppressed state.

Next, the internal structure of the platform gap filler 10 will be described in detail.

Figure 3:
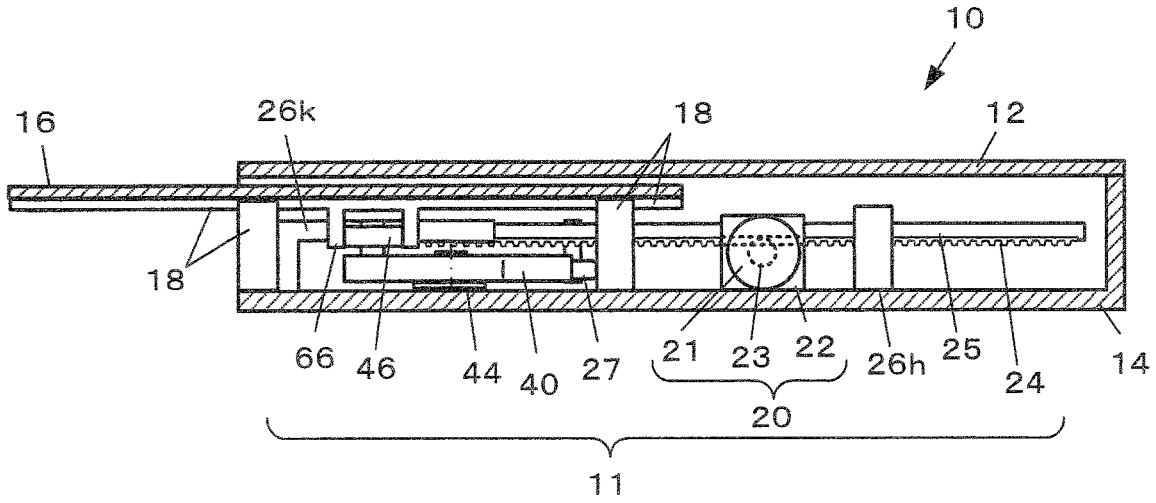
FIG. 3 is a cross-sectional view of FIG. 2(1) taken along line A-A.

FIGS. 2 and 3 are diagrams illustrating the internal structure of the platform gap filler 10 stored in the internal space according to the present embodiment, which illustrate the fully protruded state.

FIG. 2(1) is a perspective top view of the top plate 12, the main frame 14, and the gap filler plate 16, and FIG. 2(2) is an enlarged partial view of the forward/backward movement mechanism section 11. FIG. 3 is a cross-sectional view of FIG. 2(1) taken along line A-A.

The forward/backward movement mechanism section 11 includes:

1) an electric motor 21 that is electrically controlled by a control device not illustrated;

2) a deceleration mechanism 22 that decelerates appropriately the rotation of an output shaft of the electric motor 21;

3) a pinion gear 23 that is coupled to an output shaft of the deceleration mechanism 22;

4) a driving slider 25 that has a rack 24 to engage with the pinion gear 23 and constitutes a linear motion body slid by the rotation of the pinion gear 23;

5) a track-side slider guide 26*k* and a platform-side slider guide 26*h* that support the driving slider 25 in such a manner as to be slidable in the forward and backward movement directions of the gap filler plate 16;

6) a driving end roller 27 that rotates around a vertical shaft on the lower surface of the driving slider 25; and 7) a swing body 40.

The electric motor 21 contains an absolute-type encoder, for example, that outputs externally the absolute number of rotations (the number of rotations from the fully stored state or the fully protruded state) to the control device of the platform gap filler 10. The driving slider 25 is installed in such a manner as to be movable along the forward and backward movement directions of the gap filler plate 16. The track-side slider guide 26*k* is erected on the bottom surface of the main frame 14.

The pinion gear 23 and the driving slider 25 act as a linear motion mechanism with the electric motor 21 as a power source to move linearly the driving end roller 27. The electric motor 21, the deceleration mechanism 22, and the pinion gear 23 constitute a drive mechanism section 20 that moves linearly the driving slider 25 as a linear motion body and the driving end roller 27.

The position of the driving slider 25 can be lowered by setting the pinion gear 23 as a bevel gear and engaging 24 teeth of the rack with the pinion. The linear motion mechanism can be implemented by a ball screw, a chain, a timing belt, or the like, to move linearly the driving end roller 27.

Figure 4:
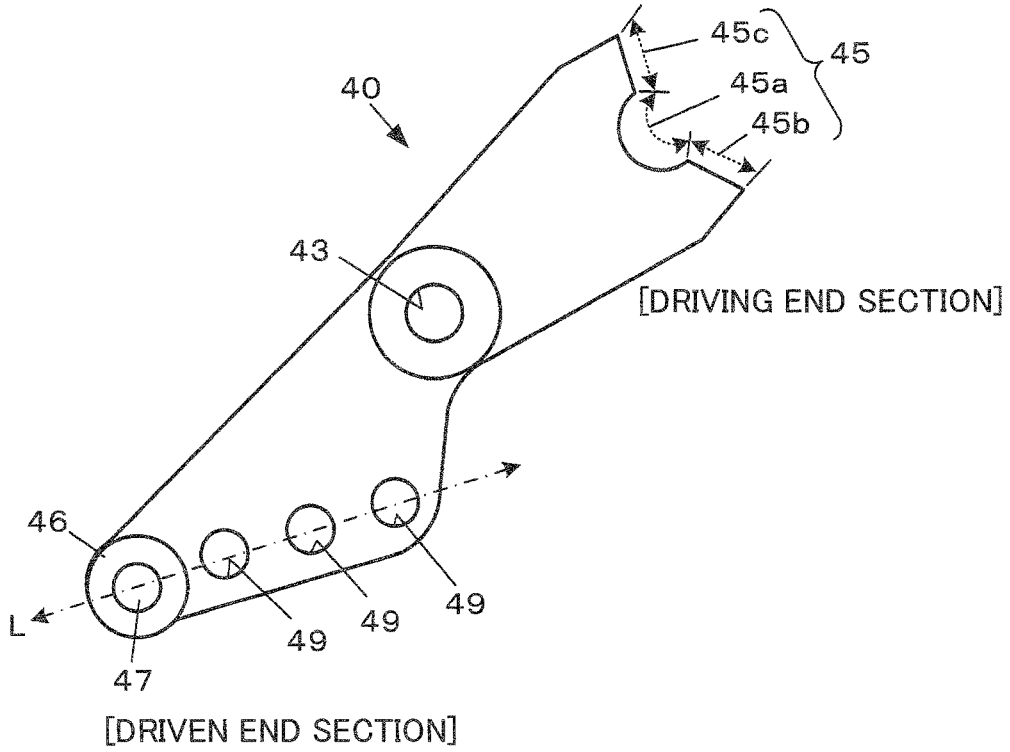
FIG. 4 is a diagram illustrating an example of a swing body.

FIG. 4 is an upper perspective plane view of a configuration example of the swing body 40.

The swing body 40 is spanner-like in shape in a top view, and is rotatably pivoted by a swing shaft 44 (see FIGS. 2 and 3) erected almost vertically from the main frame 14. The swing body 40 has a roller rolling surface 45 to abut with the driving end roller 27 at one end (driving end section) on the forward/backward movement mechanism section 11 side, and has a driven end roller 46 rotating around a vertical axis at the other end (driven end section) on the opposite side with a swing shaft hole 43 passing through the swing shaft 44 therebetween.

The roller rolling surface 45 has a changeover surface 45*a* arc-shaped in a top view and a fully protruded state lock surface 45*b* and a fully stored state lock surface 45*c* that run in a line from the both ends of the changeover surface in the rotation direction of the swing body 40.

The fully protruded state lock surface 45*b* is arranged to satisfy a geometric condition that the direction of the normal is orthogonal or almost orthogonal to the linear motion direction of the driving end roller 27 (that is, the linear motion direction of the driving slider 25) in the positional relationship between the driving end roller 27 and the swing body 40 in the fully protruded state. In other words, the fully protruded state lock surface 45*b* is formed as a plane or almost plane along or almost along the movement direction of the driving end roller 27 in the fully protruded state.

Similarly, the fully stored state lock surface 45*c* is arranged to satisfy a geometric condition that the direction of the normal of the fully stored state lock surface 45*c* is orthogonal or almost orthogonal to the linear motion direction of the driving end roller 27 in the positional relationship between the driving end roller 27 and the swing body 40 in the fully stored state.

The driven end roller 46 engages with a guide groove 66 formed in the lower surface of a driven slider 62 (see FIGS. 2 and 3). The driven slider 62 is fixed to the back side of the slide rail 18 fixed by a bolt or the like to the back side of the gap filler plate 16. The guide groove 66 is provided in a direction orthogonal or almost orthogonal to the forward and backward movement directions of the gap filler plate 16. The driven end roller 46 engages in the guide groove 66.

The other end of the swing body 40 has a plurality of driven end roller installation holes 49 different in distance from the swing shaft hole 43 along a predetermined displacement installation-capable direction L. The displacement installation-capable direction L is set to avoid the center of the swing shaft 44 of the swing body 40. The number of the driven end roller installation holes 49 can be set as appropriate. In addition, re-inserting a roller pin 47 of the driven end roller 46 into any of the driven end roller installation holes 49 makes it possible to change the installation position of the driven end roller 46. That is, the movement distance of the driven end roller 46 can be changed at each swing angle of the swing body 40, which allows the adjustment of the protrusion amount of the gap filler plate 16.

In correspondence with the capability of adjustment of the protrusion amount of the gap filler plate 16, in the present embodiment, a movement restriction section is also made adjustable for limiting the forward and backward movable range of the gap filler plate 16.

Specifically, as illustrated in FIG. 2, as the movement restriction section, a track-side engagement projection 76*k* and a platform-side engagement projection 76*h* are erected downward on the lower surface of the gap filler plate 16 along the movement directions (forward and backward movement directions) of the gap filler plate 16. In addition, erected on the bottom surface of the main frame 14 are a track-side stopper 72*k* with which the track-side engagement projection 76*k* abuts in the fully protruded state and a platform-side stopper 72*h* with which the platform-side engagement projection 76*h* abuts in the fully stored state. The distance between the two stoppers constitutes the movement restricted distance of the gap filler plate 16.

Figure 5:
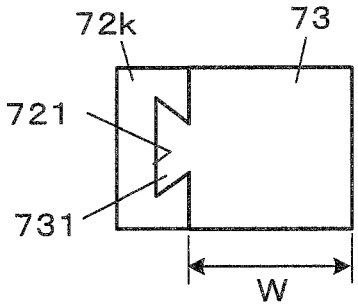
FIG. 5(1) is a top view of a configuration example of a track-side stopper, and FIG. 5(2) is a side view of the same.
Figure 5:
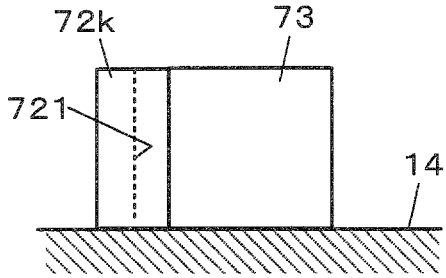

Moreover, a spacer 73 is detachably attached to the platform-side surface of the track-side stopper 72*k* to adjust the movement restricted distance. Specifically, as illustrated in FIG. 5(1), the track-side stopper 72*k* has a perpendicular engagement groove 721 in a top view in the platform-side surface. The engagement groove 721 is designed such that an engagement projection 731 of the spacer 73 is insertable and extractable in the perpendicular direction but is not insertable or extractable in the horizontal direction.

A plurality of kinds of spacers 73 different in adjustment thickness W (the thickness of the gap filler plate 16 as seen in the movement direction) are prepared. Selecting the kind of the spacer 73 to be attached to the track-side stopper 72*k* (including the case of not attaching) depending on in which of the driven end roller installation holes 49 the driven end roller 46 is to be inserted makes it possible to adjust appropriately the movement restricted distance of the gap filler plate 16.

The protrusion amount of the gap filler plate 16 can be adjusted in step [1] removing the top plate 12, step [2] detaching the gap filler plate 16 from the slide rail 18, step [3] detaching the slide rail 18 and the driven slider 62, step [4] changing the attachment position of the driven end roller 46, and step [5] changing the spacer 73. As a matter of the course, for labor saving in steps [1] to [3], a first open/close lid section for changing the attachment position of the driven end roller 46 (also called adjustment window or inspection hole) and a second open/close lid section for changing the spacer 73 may be provided on the top plate 12 and the gap filler plate 16.

Figure 6:
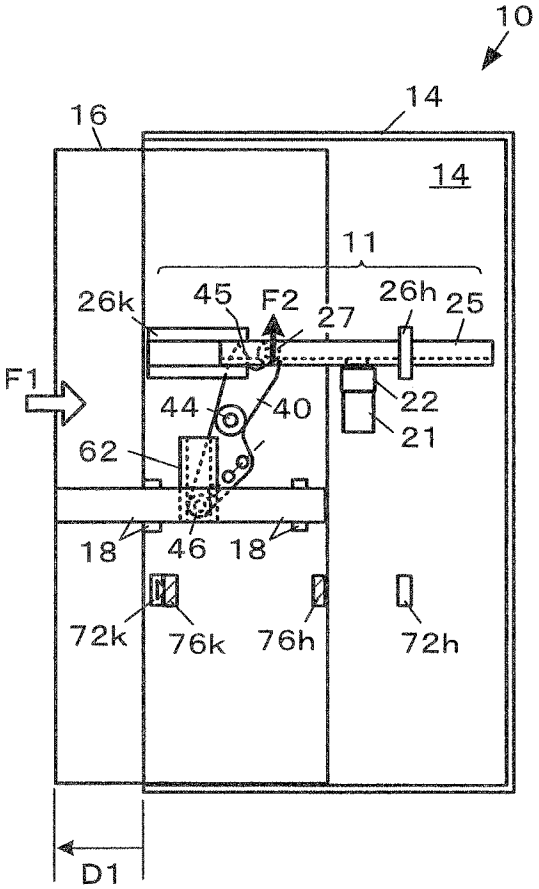
FIGS. 6(1) to 6(3) are diagrams illustrating the internal structure of the platform gap filler, and FIG. 6(1) illustrates the fully protruded state, FIG. 6(2) illustrates a transition process, and FIG. 6(3) illustrates a fully stored state.
Figure 6:
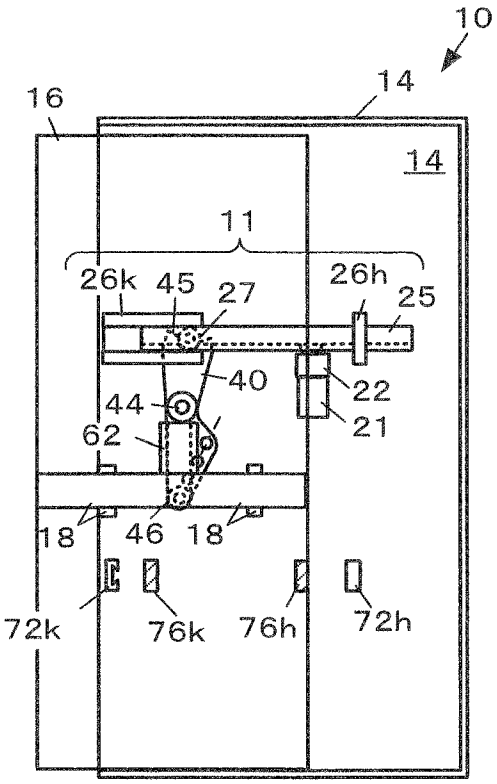
Figure 6:
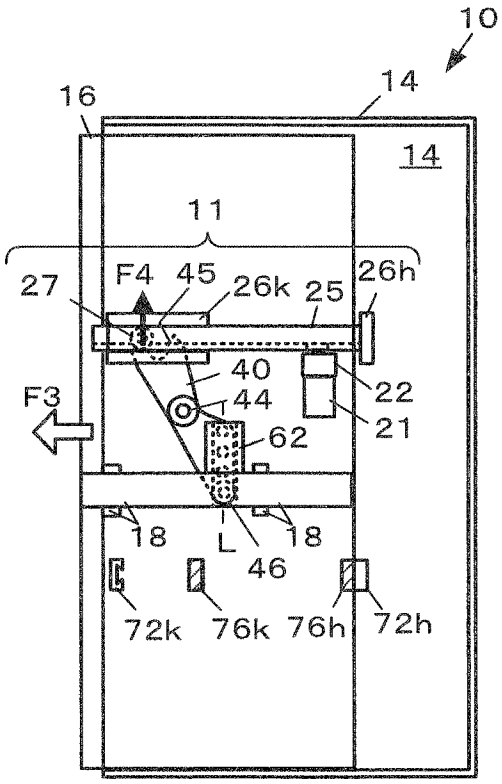

Operations of the platform gap filler 10 will be described below. FIGS. 6(1) to 6(3) are enlarged views of a principle mechanism for moving the gap filler plate 16, and FIG. 6(1) illustrates the fully protruded state, FIG. 6(2) illustrates the transition process, and FIG. 6(3) illustrates the fully stored state.

As illustrated in FIG. 6(1), in the platform gap filler 10 in the fully protruded state, the driving end roller 27 is in abutment with the fully protruded state lock surface 45*b* of the roller rolling surface 45 (see FIG. 4).

In the fully protruded state, the forward/backward movement mechanism section 11 can lock the gap filler plate 16 in the movement suppressed state. The lock state can be maintained due to a mechanical and dynamic structure without the need for electric power. Specifically, when there occurs acting force F1 (outline arrow) for moving the gap filler plate 16 in the storage direction, the driven slider 62 presses the driven end roller 46 in the storage direction (platform direction). Accordingly, the swing body 40 develops a counterclockwise torque, and the roller rolling surface 45 presses the driving end roller 27 by acting force F2 (solid arrow). At this time, the driving end roller 27 is in abutment with the fully protruded state lock surface 45*b* (see FIG. 4), and thus the direction of the acting force F2 is orthogonal or almost orthogonal to the direction in which the driving end roller 27 is linearly moved by the drive mechanism section 20, under a geometric condition. As a result, the acting force F2 is borne by the driving end roller 27 and is insufficient to move the driving slider 25, and thus the swing body 40 is not rotated. This constitutes an inverse operation preventive structure that interferes with the inverse power transfer from the swing body 40 to the driving end roller 27. Even in the event of inverse power transfer, the swing body 40 is not rotated so that the gap filler plate 16 is locked and is unmovable in the storage direction.

In addition, in the fully protruded state, if an attempt is made to further protrude the gap filler plate 16 toward the track side, the track-side engagement projection 76*k* erected on the lower surface of the gap filler plate 16 is in abutment with the track-side stopper 72*k*, and thus the gap filler plate 16 does not protrude any more to the track side.

When the electric motor 21 is rotationally driven in a predetermined direction to store the gap filler plate 16, the driving slider 25 is moved to the track side (the left side in FIGS. 6(1) to 6(3)) and the driving end roller 27 is also moved to the track side. Accordingly, the swing body 40 rotates counterclockwise, and the driving end roller 27 moves from the fully protruded state lock surface 45*b* to the changeover surface 45*a* as illustrated in FIG. 6(2) (see FIG. 4). That is, in the case of forward motion transfer, the fully protruded state is unlocked automatically and smoothly.

When the driving end roller 27 moves to the changeover surface 45*a*, the driving end roller 27 fits in the inner space arc-shaped in a top view formed by the changeover surface 45*a*, and the swing body 40 further rotates counterclockwise along with the linear motion of the driving end roller 27. When the swing body 40 rotates counterclockwise due to the forward power transfer from the driving end roller 27 to the swing body 40, the driven end roller 46 moves relatively to the platform side to move the driven slider 62 and the gap filler plate 16 to the platform side.

As the rotational driving of the electric motor 21 continues, the gap filler plate 16 finally reaches the fully stored state illustrated in FIG. 6(3). In the fully stored state, the driving end roller 27 comes out of the changeover surface 45*a* and moves to the fully stored state lock surface 45*c* (see FIG. 4). After making a predetermined number of rotations necessary for moving the driving slider 25 to a predetermined fully stored position, the electric motor 21 is stopped.

In the fully stored state, the displacement installation-capable direction L is orthogonal or almost orthogonal to the forward and backward movement directions (movement directions) of the gap filler plate 16. In other words, the displacement installation-capable direction L in the fully stored state is made along the guide groove 66, which is parallel or almost parallel to the guide groove 66.

Then, the gap filler plate 16 is brought into the movement suppressed state. Specifically, when there occurs acting force F3 (open arrow) for moving the gap filler plate 16 to a protrusion direction (track direction: leftward in FIGS. 6(1) to 6(3)), the driven slider 62 presses the driven end roller 46 in the protrusion direction. The swing body 40 develops a torque for clockwise rotation, and the fully stored state lock surface 45*c* presses the driving end roller 27 by acting force F4 (solid arrow). However, due to the geometric relationship between the two, the direction of the acting force F4 is orthogonal or almost orthogonal to the direction in which the driving end roller 27 is linearly moved by the drive mechanism section 20. As a result, the acting force F4 is borne by the driving end roller 27 and is insufficient to move the driving slider 25, and thus the swing body 40 is not rotated. This constitutes an inverse operation preventive structure that interferes with the inverse power transfer from the swing body 40 to the driving end roller 27. Even in the event of inverse power transfer, the swing body 40 is not rotated so that the gap filler plate 16 is locked and is unmovable in the protrusion direction.

In addition, in the fully stored state, if an attempt is made to further press the gap filler plate 16 into the platform side, the platform-side engagement projection 76*h* erected on the lower surface of the gap filler plate 16 is in abutment with the platform-side stopper 72*h*, and thus the gap filler plate 16 does not move any more to the platform side.

When the electric motor 21 is rotationally driven in the direction opposite to the foregoing direction to protrude the gap filler plate 16, the driving slider 25 is moved to the platform side (the right side in FIGS. 6(1) to 6(3)) and the driving end roller 27 is also moved to the same direction. Accordingly, the driving end roller 27 is moved from the fully stored state lock surface 45*c* to the changeover surface 45*a*. That is, in the case of forward motion transfer, the link mechanism in the fully stored state is unlocked automatically and smoothly, and the gap filler plate 16 returns to the fully protruded state illustrated in FIG. 6(1) through the state illustrated in FIG. 6(2).

Focusing on the movement velocity of the gap filler plate 16 from the fully stored state to the fully protruded state, the direction of the guide groove 66 in the driven slider 62 in the fully stored state is orthogonal or almost orthogonal to the movement directions of the gap filler plate 16. Accordingly, the gap filler plate 16 starts to move slowly, increases speed gradually, reaches the maximum speed midway, decreases speed gradually, and then approaches slowly to the fully protruded state. This makes it possible to perform the protruding operation more efficiently than in the configuration in which the direction of the guide groove 66 in the driven slider 62 in the fully stored state is inclined with respect to the movement direction of the gap filler plate 16.

Figure 7:
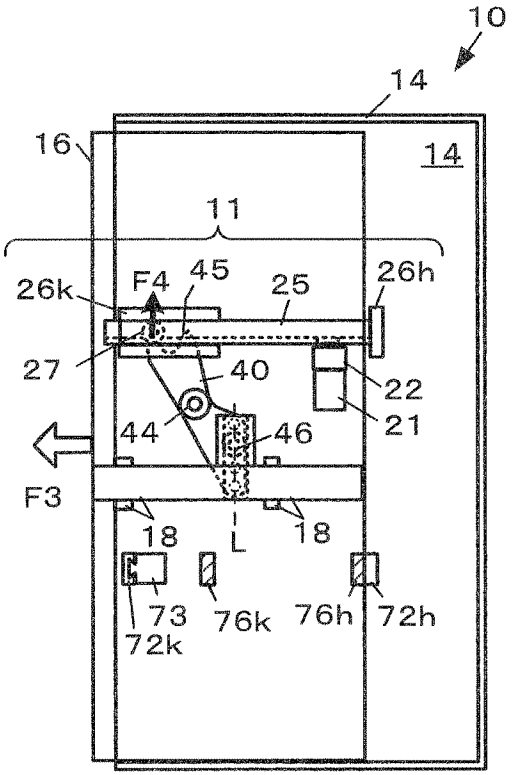
FIGS. 7(1) to 7(3) are diagrams illustrating the internal structure of the platform gap filler, and FIG. 7(1) illustrates a fully protruded state, FIG. 7(2) illustrates a transition process, and FIG. 7(3) illustrates a fully stored state with a change in the protrusion amount.
Figure 7:
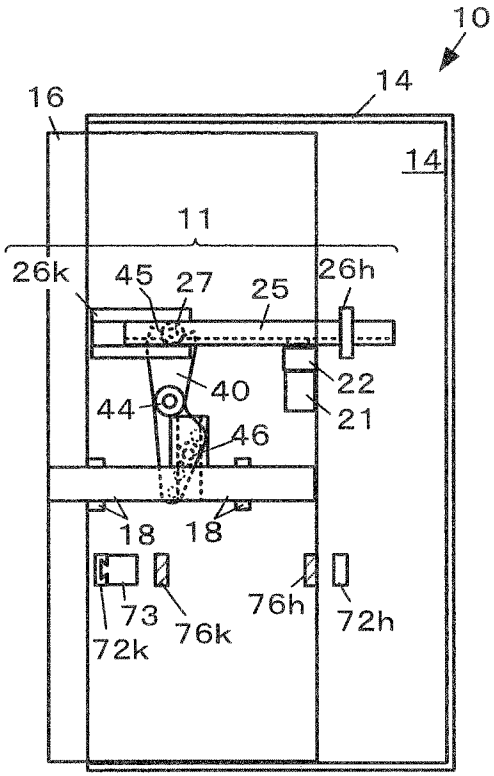
Figure 7:
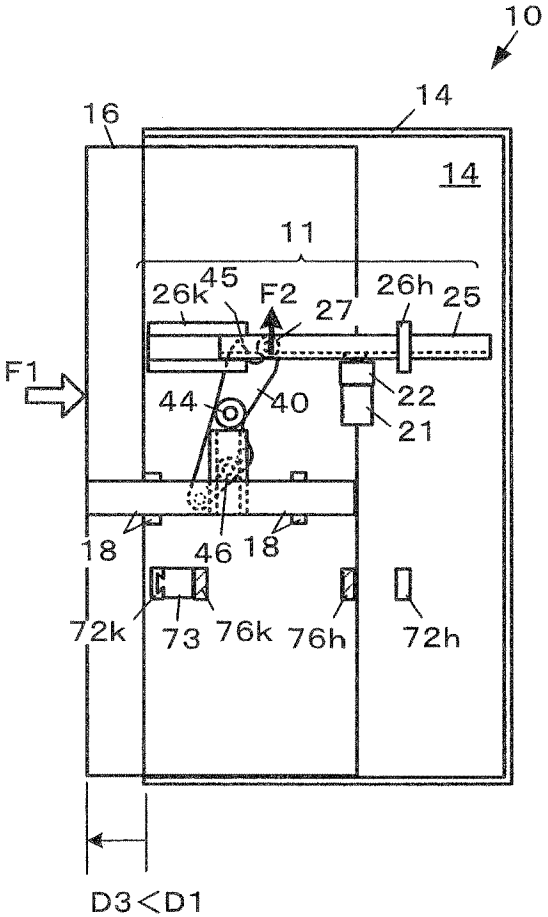

FIGS. 7(1) to 7(3) are enlarged views of a principle mechanism for moving the gap filler plate 16 when the attachment position of the driven end roller 46 is changed from the example illustrated in FIGS. 6(1) to 6(3), that is, when the protrusion amount is changed. FIG. 7(1) illustrates the fully protruded state, FIG. 7(2) illustrates the transition process, and FIG. 7(3) illustrates the fully stored state.

In a comparison between FIG. 6(1) and FIG. 7(1), the protrusion amount of the gap filler plate 16 illustrated in FIGS. 7(1) to 7(3) is smaller due to the change of the attachment position of the driven end roller 46. Along with this, the spacer 73 is attached to the track-side stopper 72*k*.

The posture of the swing body 40 in the fully protruded state is the same between FIG. 6(1) and FIG. 7(1).

On the other hand, in a comparison between FIG. 6(3) and FIG. 7(3), the posture of the swing body 40 in the fully stored state is the same. That is, in the fully stored state as described above, the alignment direction of the plurality of driven end roller installation holes 49 in the swing body 40 (the displacement installation-capable direction L) and the direction of the guide groove 66 in the driven slider 62 are parallel or almost parallel to each other. Thus, even when the attachment position of the driven end roller 46 is changed, the storage position of the driven slider 62 in the fully stored state remains unchanged. Accordingly, the platform-side engagement projection 76*h* remains in the fixed position and restricts the storage limit position of the gap filler plate 16 together with the platform-side stopper 72*h*.

That is, even when the installation position of the driven end roller 46 is changed, the operating principle and movement velocity trend of the gap filler plate 16 from the fully stored state to the fully protruded state are basically unchanged.

According to the present embodiment, the movement suppressed state (locked state) of the gap filler plate 16 can be implemented by the simple mechanical structure. This eliminates the need for an electromagnetic brake and electric power for maintaining the locked state. Implementing the lock/unlock mechanism makes it possible to identify the degree of parts deterioration at a glance, thereby achieving improvement in the correctness of maintenance checkup and reduction in the man-hours.

Even when the gap between a train and the platform varies depending on the position of the door in the curve section of the platform with the gap fillers, setting the installation position of the driven end roller 46 and selecting the spacer 73 (including the case of not attaching the spacer 73) appropriately makes it easy to set the proper protrusion amount of the gap filler plate 16 for each of the platform gap filler 10. In addition, the setting of the protrusion amount can be changed without the need for adjustment of the platform-side stopper 72*h* and the platform-side engagement projection 76*h*.

The protruding action of the gap filler plate 16 from the fully stored state to the fully protruded state takes place such that the gap filler plate 16 starts to move slowly, increases speed gradually, reaches the maximum speed midway, decreases speed gradually, and then approaches slowly to the fully protruded state.

[Modifications]

The mode to which the present invention is applicable is not limited to the present embodiment but constituent elements can be added, omitted, and changed as appropriate.

[1]

Figure 8:
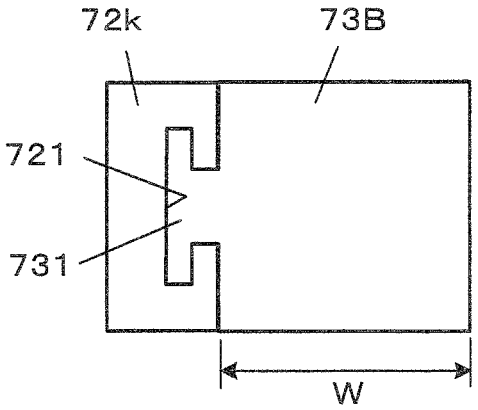
FIG. 8(1) is a top view of a modification of the track-side stopper, and FIG. 8(2) is a side view of the same.
Figure 8:
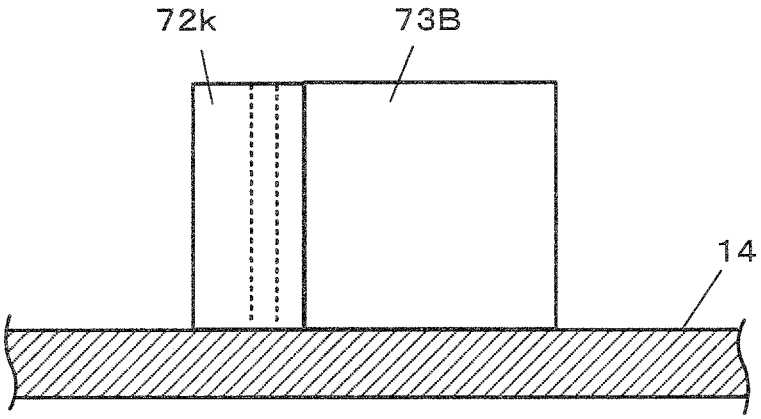

The form of engagement between the track-side stopper 72*k* and the spacer 73 is not limited to the example of FIG. 5 but may be another form such as using a spacer 73B illustrated in FIG. 8.

[2]

Figure 9:
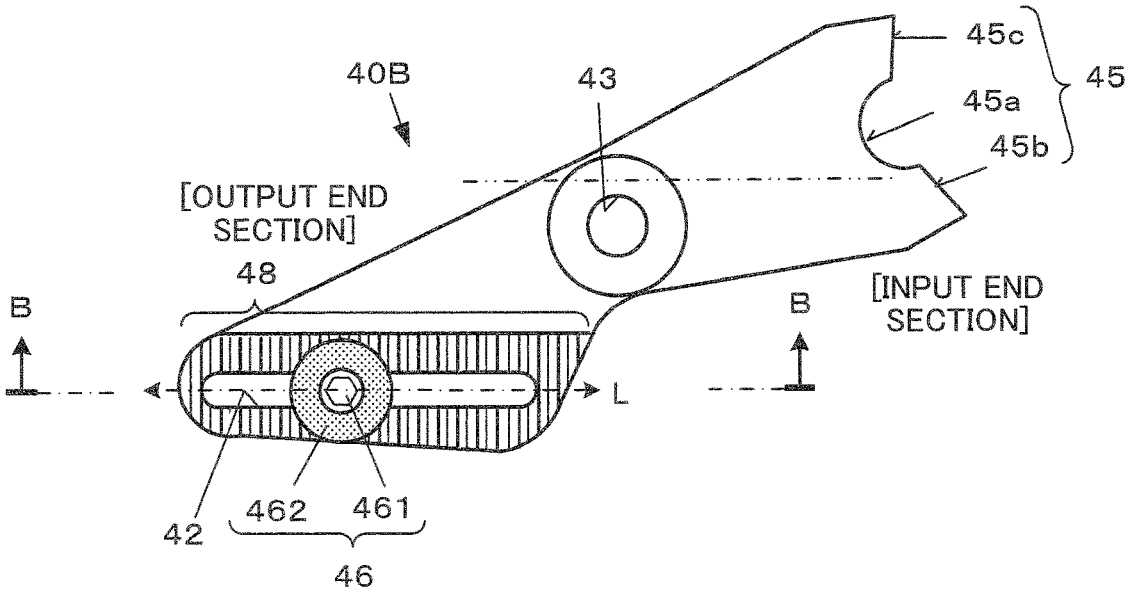
FIG. 9(1) and FIG. 9(2) are diagrams illustrating a modification of the swing body.
Figure 9:
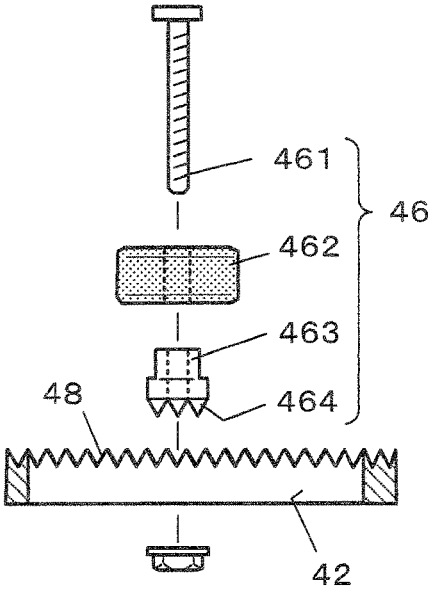

The structure for adjusting the attachment position of the driven end roller 46 is not limited to the scheme based on the number and position of the driven end roller installation holes 49. For example, as illustrated in FIG. 9, a swing body 40B is provided with a long hole 42 into which a through bolt 461 of the driven end roller 46 can be inserted, in the installation range of the driven end roller 46 along the displacement installation-capable direction L. In addition, the swing body 40B has a fitting concave-convex section 48 provided around the long hole 42. The through bolt 461 is inserted into the long hole 42 via a roller body 462 and a roller seat 463. The roller seat 463 also has projections 464 to fit with the concave and convex portions in the fitting concave-convex section 48. According to this configuration, the position of the driven end roller 46 can be adjusted more finely than in the foregoing embodiment, depending on the pitch of the concave and convex portions in the fitting concave-convex section 48.

In correspondence with this configuration, the track-side stopper 72*k* is preferably made capable of fine adjustment.

Figure 10:
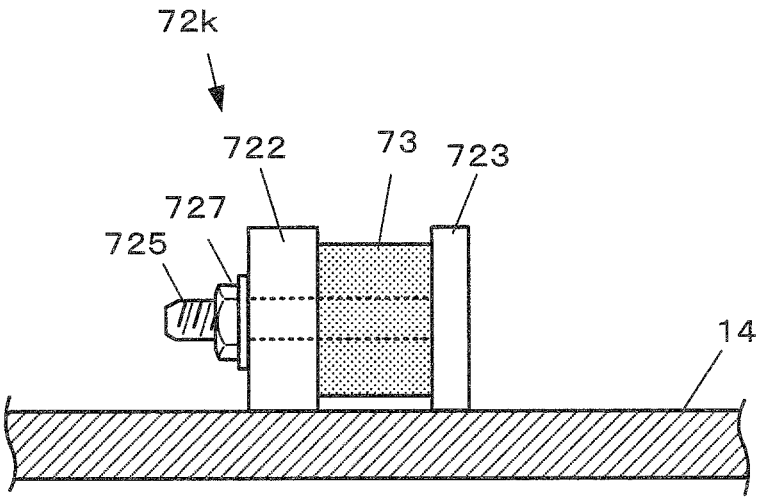
FIG. 10 is a diagram illustrating a modification of the track-side stopper.

Specifically, as illustrated in FIG. 10, the track-side stopper 72*k* has a base 722 and an engagement body 723. The base 722 is fixed to the bottom surface of the main frame 14. The engagement body 723 includes integrally an adjustment bolt 725. The base 722 and the spacer 73 have an insertion hole for the adjustment bolt 725. The spacer 73 is sandwiched between the base 722 and the engagement body 723 and fixed integrally by the adjustment bolt 725 and a nut 727.

Figure 11:
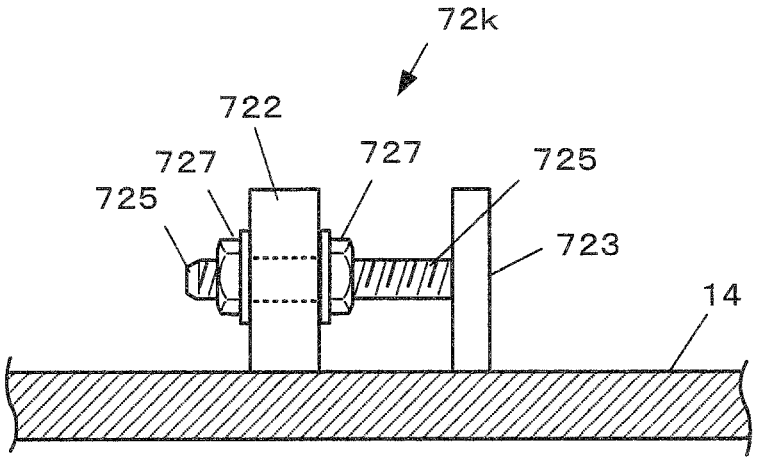
FIG. 11 is a diagram illustrating a modification of the track-side stopper.

Alternatively, as illustrated in FIG. 11, the spacer 73 may be omitted from the configuration illustrated in FIG. 10 so that the engagement body 723 is fixed to the base 722 by two nuts 727.

[3]

Figure 12:
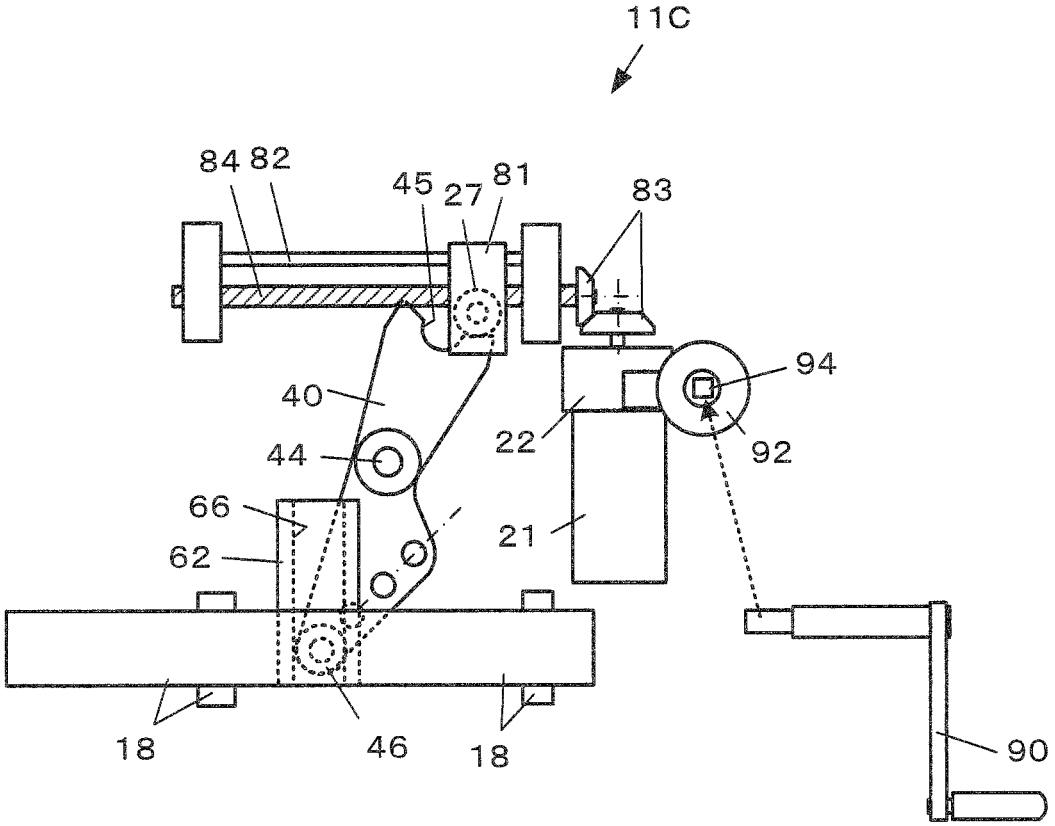
FIG. 12 is a diagram illustrating a modification of a drive mechanism section.

For example, as in a forward/backward movement mechanism section 11C illustrated in FIG. 12, a hand-turned handle 90 is further preferably attached to the deceleration mechanism 22 to provide a manually rotatable gear mechanism 92. When power supply to the platform gap filler 10 is shut off, inserting and coupling the hand-turned handle 90 into a coupling hole 94 in the gear mechanism 92 allows the pinion gear 23 (see FIG. 2) to be rotated without electric power. Further preferably, a small door is installed in the top plate 12 (see FIG. 1) to provide an access to the coupling hole 94 without having to remove the top plate 12.

[4]

The linear motion mechanism of the driving end roller 27 formed from the pinion gear 23 and the rack 24 in the foregoing embodiment may be a ball screw-type linear motion mechanism such as the forward/backward movement mechanism section 11C illustrated in FIG. 12 in which a guide block 81 with the driving end roller 27 is slidably supported by a guide rail 82 and is linearly moved by a ball screw 84 obtaining rotational force from the output shaft of the deceleration mechanism 22 via a bevel gear 83. Alternatively, the linear motion mechanism may be a belt-driven linear motion mechanism.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A gap filler that protrudes a gap filler plate to a track side to prevent passengers' falling from a platform, comprising:

a drive mechanism section that moves linearly a linear motion body;

a swing body that has a driving end section and a driven end roller section, the driving end section being engaged with the linear motion body and the driven end roller section being engaged with the gap filler plate and changeable in installation position in a predetermined direction; and a driven slider that has a guide groove in which the driven end roller section is capable of rolling to convert swing motion of the swing body into linear motion and move the gap filler plate in forward and backward movement directions, wherein an engagement relationship between the linear motion body and the driving end section constitutes an inverse operation preventive structure that, when the gap filler plate is in either a fully protruded state or a fully stored state, enables only motion transfer from the linear motion body to the driving end section, the guide groove is formed in a direction orthogonal or almost orthogonal to forward and backward movement directions of the gap filler plate, and the predetermined direction and the direction of the guide groove are parallel to each other in the fully stored state.

2. The gap filler as defined in claim 1, the predetermined direction being set to avoid a center of a swing shaft of the swing body.

3. The gap filler as defined in claim 1, the inverse operation preventive structure establishing an engagement relationship satisfying a geometric condition that, in either the fully protruded state or the fully stored state, a direction of action from the driving end section to the linear motion body is orthogonal or almost orthogonal to a linear motion direction of the linear motion body.

4. The gap filler as defined in claim 2, the inverse operation preventive structure establishing an engagement relationship satisfying a geometric condition that, in either the fully protruded state or the fully stored state, a direction of action from the driving end section to the linear motion body is orthogonal or almost orthogonal to a linear motion direction of the linear motion body.

5. The gap filler as defined in claim 3, the linear motion body including a roller for engagement with the driving end section, and the driving end section having rolling surfaces for the roller including two lock surfaces and a changeover surface, wherein one surface of the two lock surfaces contacting the roller in the fully protruded state and having a direction of a normal orthogonal or almost orthogonal to the linear motion direction;

the other surface of the two lock surfaces contacting the roller in the fully stored state and having a direction of a normal orthogonal or almost orthogonal to the linear motion direction, and the changeover surface being an arc-shaped surface contacting the roller during changeover between the fully protruded state and the fully stored state and connecting the two lock surfaces.

6. The gap filler as defined in claim 4, the linear motion body including a roller for engagement with the driving end section, and the driving end section having two lock surfaces and a changeover surface, as rolling surfaces for the roller, wherein one surface of the two lock surfaces contacting the roller in the fully protruded state and having a direction of a normal orthogonal or almost orthogonal to the linear motion direction;

the other surface of the two lock surfaces contacting the roller in the fully stored state and having a direction of a normal orthogonal or almost orthogonal to the linear motion direction, and the changeover surface being an arc-shaped surface contacting the roller during changeover between the fully protruded state and the fully stored state and connecting the two lock surfaces.

7. The gap filler as defined in claim 1, the drive mechanism section having a rack-and-pinion mechanism.

* * * * *